US007958737B2

(12) United States Patent
Lifson et al.

(10) Patent No.: US 7,958,737 B2
(45) Date of Patent: Jun. 14, 2011

(54) METHOD AND CONTROL FOR PREVENTING FLOODED STARTS IN A HEAT PUMP

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 694 days.

(21) Appl. No.: 11/916,469

(22) PCT Filed: Jun. 6, 2005

(86) PCT No.: PCT/US2005/019873
§ 371 (c)(1),
(2), (4) Date: Dec. 4, 2007

(87) PCT Pub. No.: WO2006/132632
PCT Pub. Date: Dec. 14, 2006

(65) Prior Publication Data

US 2008/0196418 A1 Aug. 21, 2008

(51) Int. Cl.
*F25B 41/00* (2006.01)
*F25D 21/00* (2006.01)
*F25D 21/06* (2006.01)

(52) U.S. Cl. ..... 62/81; 62/80; 62/151; 62/155

(58) Field of Classification Search ..... 62/150, 62/151, 155, 156, 158, 160, 80, 81, 324.6
See application file for complete search history.

(56) References Cited

U.S. PATENT DOCUMENTS 5,319,943 A * 6/1994 Bahel et al. ..... 62/156
2005/0011206 A1 1/2005 Luo et al.

FOREIGN PATENT DOCUMENTS

DE 3023769 1/1982
JP 01155154 A * 6/1989
JP 1096573 4/1998
JP 10096573 A * 4/1998
JP 2002206786 7/2002
JP 2002206786 A * 7/2002

OTHER PUBLICATIONS

European Search Report dated Feb. 18, 2009.
International Preliminary Report on Patentability dated Dec. 21, 2007.
Search Report PCT/US2005/19873, Nov. 15, 2005.

* cited by examiner

*Primary Examiner* — Chen-Wen Jiang
(74) *Attorney, Agent, or Firm* — Carlson, Gaskey & Olds, PC

(57) ABSTRACT

A heat pump is provided with an improvement while switching from heating/cooling mode to a defrost mode. Prior to initiation of a defrost mode, an electronic expansion device is moved to an open position such that refrigerant can migrate between the indoor-outdoor heat exchangers. When the operation of the defrost cycle is initiated, there is a lower likelihood and severity of flooded starts, as the refrigerant, under existing pressure differential at system shutdown, will move to the heat exchanger that will be downstream of the compressor in the defrost mode. Thus, no flooded start will occur on the subsequent compressor start-up. After completion of the defrost cycle, the electronic expansion device is again opened prior to return to operation in the conventional heating/cooling mode. In case subsequent starts are in an identical mode of operation, the electronic expansion valve is kept closed during shutdown to minimize cyclic performance losses.

20 Claims, 1 Drawing Sheet

METHOD AND CONTROL FOR PREVENTING FLOODED STARTS IN A HEAT PUMP

BACKGROUND OF THE INVENTION

This application relates to a method and control that serve to reduce the incidence of flooded starts in a heat pump, and particularly while switching between conventional heating and defrost modes of operation.

Refrigerant systems are utilized to control the temperature and humidity of air in various indoor environments to be conditioned. In a typical refrigerant system operating in a cooling mode, a refrigerant is compressed in a compressor and delivered to a condenser (or an outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

The above description is of a refrigerant system being utilized in a cooling mode of operation. In the heating mode, the refrigerant flow through the system is essentially reversed. The indoor heat exchanger becomes the condenser and releases heat into the environment to be conditioned (heated in this case) and the outdoor heat exchanger serves the purpose of the evaporator where heat is transferred from a relatively cold outdoor air to the refrigerant. Heat pumps are known as the systems that can reverse the refrigerant flow through the refrigerant cycle, in order to operate in both heating and cooling modes. This is usually achieved by incorporating a four-way reversing valve (or an equivalent device) into the system schematic downstream of the compressor discharge port. The four-way reversing valve selectively directs the refrigerant flow through indoor or outdoor heat exchanger when the system is in the heating or cooling mode of operation respectively. If the expansion device cannot handle the reversed flow, then, for example, a pair of expansion devices, each along with a check valve, may be employed instead.

One control feature that is typically incorporated into heat pumps, is a defrost cycle. Typically, the heat exchanger that is cooling the refrigerant will be subject to icing under certain conditions. A defrost cycle is intended to melt the ice on the evaporator and restore efficient and reliable system operation. In the case of a heat pump operating in a cooling mode, it will be the indoor heat exchanger that could potentially ice, and in a heat pump operating in a heating mode, it will be the outdoor heat exchanger that ices, particularly at lower ambient temperatures. When it is desired to initiate a defrost cycle, the four-way reversing valve that routes the refrigerant through the heat pump in a proper direction for cooling/heating mode would be reversed. Thus, hot refrigerant is sent directly to the heat exchanger that has been subject to icing conditions. Essentially, for the defrost operation in a heating mode, the compressor would drive the refrigerant in a cooling mode direction, and for the defrost in a cooling mode, the compressor would drive the refrigerant in a heating mode direction. In practice, the defrost cycle in heat pumps is most frequently utilized in the heating mode of operation.

Defrost cycles raise reliability concerns in heat pumps due to damage to various system components, such as internal compressor components, as well as system components located on the discharge line such as the four-way reversing valve, check valves, etc. Such damage is predominantly caused by flooded starts. A flooded start can occur due to alternating between a conventional heating/cooling and defrost modes of operation in heat pumps, since when the four-way reversing valve is switched, the duties of the indoor and outdoor heat exchangers are also switched.

As an example, when switching from a heating mode to a defrost mode, the indoor heat exchanger becomes the evaporator. Prior to the defrost cycle, it was a condenser. The outdoor heat exchanger now becomes a condenser, and it was the evaporator before the defrost mode of operation was activated.

The outdoor heat exchanger is now exposed to the hot discharge gas, and the defrost will occur. However, flooded conditions at the compressor suction can also be associated with this defrost operation initiation. The flooded start problem occurs because most of the refrigerant would be located in the indoor coil from the past operation in the heating mode when the defrost cycle is first started. When the four-way reversing valve switches to a defrost mode, and the compressor starts, the liquid refrigerant stored in the indoor coil now moves directly into the compressor suction port. This can cause severe flooded start problems, and as described above, can lead to permanent component damage.

The possibility of having a flooded start would occur again when the system is switched back from a defrost mode of operation to a heating mode.

Further, flooded starts are observed in the cooling mode of operation as well and have similar impact on system reliability.

SUMMARY OF THE INVENTION

The present invention utilizes the electronically controlled expansion valve to address the above-described flooded start problem. When it is determined that a defrost cycle is to be initiated, the electronic expansion valve is moved to an open position at system shutdown, and before the defrost cycle begins.

As an example, in the above-described operation in a heating mode, when the electronic expansion valve is opened at shutdown, the refrigerant located in the indoor coil will move to the outdoor coil due to the pressure differential that will exist between the high and low sides of the system immediately after the system shutdown. Since the refrigerant has moved to the outdoor coil after the shutdown, when the system is started up again or shortly before the start up the four-way reversing valve is switched to initiate the defrost cycle, there will no longer be a flooded start situation or its severity will be appreciably reduced.

It is also preferred that at the end of the defrost cycle, the electronic expansion valve is opened once again, such that the refrigerant can move back from the outdoor coil to the indoor coil under the driving force of existing pressure differential at shutdown. When the system is again started in its normal heating mode, there will be no or very little liquid refrigerant in the outdoor coil as the majority of the liquid refrigerant would have migrated into the indoor coil, and no flooded start will occur as the refrigerant will be entering the compressor from the outdoor coil.

In a disclosed embodiment, the electronic expansion valve is moved to a fully opened position before the defrost cycle initiation and/or after the defrost cycle termination. Notably, during normal (non-defrost) system shutdowns, the electronic expansion valve can be shut off to reduce system losses associated with pressure equalization between high and low system sides.

These and other features of the present invention can be best understood from the following specification and drawings, the following of which is a brief description.

DETAILED DESCRIPTION OF THE PREFERRED EMBODIMENTS

Figure 1:
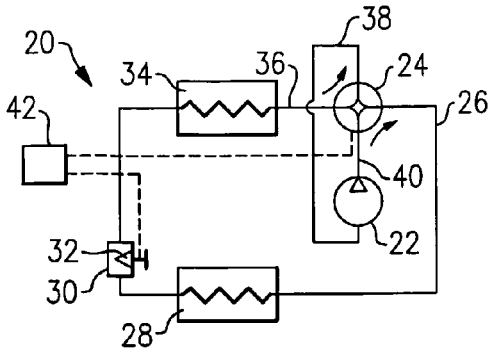
FIG. 1 is a schematic view of a refrigerant cycle operating in heating mode.

FIG. 1 shows a refrigerant system 20 incorporating a compressor 22 and a four-way valve 24. As known, the four-way reversing valve 24 can be switched between two positions, and is illustrated in FIG. 1 in a heating mode position. In the heating mode position, a discharge line 40 delivers compressed refrigerant vapor from the compressor 22 into a line 26 leading to an indoor heat exchanger 28. The refrigerant passes through the indoor heat exchanger 28, and to an electronic expansion valve 30. As shown schematically, a valve member 32 is movable to provide a desired amount of restriction within the expansion device 30. A control 42 controls the expansion device 30 and the four-way reversing valve 24.

Downstream of the expansion device 30 is an outdoor heat exchanger 34. A line 36 downstream of the outdoor heat exchanger 34 passes once again through the four-way reversing valve 24, and when in the heating mode position as illustrated in FIG. 1, the line 36 will communicate with a suction line 38 that delivers refrigerant into a suction port of the compressor 22.

As is known in the prior art, the position of the closing member (e.g. plunger or needle) 32 within the expansion device 30 will vary in the heating mode, as well as in the cooling mode, depending on environmental conditions and a particular mode of operation. Also, as is known, the control 42 is programmed to monitor various system operating parameters and to control the electronic expansion valve to maintain these parameters within the specified envelope for a wide range of environments and potential applications.

Figure 2:
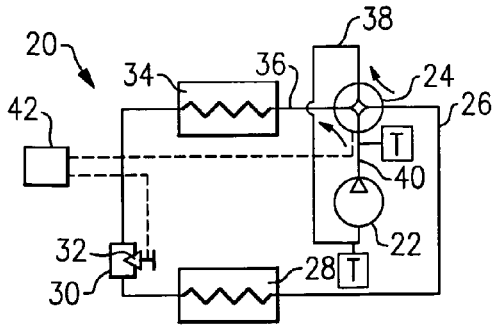
FIG. 2 is a schematic view of the refrigerant cycle operating in defrost mode.

Under certain conditions, and when in the heating mode, the outdoor heat exchanger 34 may be subject to icing. Thus, a necessity for a defrost mode of operation may be indicated to the controller 42. As shown in FIG. 2, when the defrost mode is activated, the position of the four-way valve 24 is reversed. Refrigerant now passes from the discharge line 40, through the four-way valve 24, into the line 36 and then through the outdoor heat exchanger 34. The refrigerant in the line 40 will be relatively hot, and thus will melt the ice accumulated on the outdoor heat exchanger 34. As shown in this Figure, and again schematically, the position of the closing member 32 within the electronic expansion device 30 will differ in this cooling/defrost mode in comparison to the FIG. 1 heating mode position.

It should be understood that when the refrigerant system 20 is operated in a cooling mode (to cool and dehumidify the conditioned space), it will be run in the FIG. 2 position, and when the defrost mode is activated, it will be moved to the FIG. 1 position. In this manner, the ice that has accumulated on the indoor heat exchanger 28 during the cooling mode, will be melted by the hot refrigerant from the discharge line 40 passing directly into the line 26 and thus through the indoor heat exchanger 28. In other words, system conventional and defrost operation in the cooling mode is opposite to its operation in the heating mode. As mentioned above, such application of the defrost for the cooling mode of operation is less frequent than for the heating mode.

Figure 3:
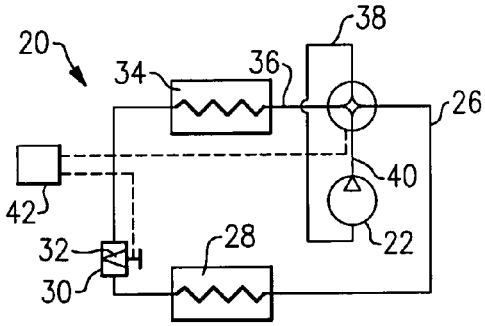
FIG. 3 shows the system shut down between subsequent heating cycles.

During normal operation, and when subsequent stops and starts of the system are all in the same mode, the electronic expansion device 30 may be moved to a fully closed position with the closing member 32 shutting off any communication between the heat exchangers 34 and 28. This position is shown in FIG. 3 and would avoid performance loss due to pressure equalization between subsequent start cycles.

However, should it be determined that a defrost mode is required, the system is shut down, and the electronic expansion device 30 is moved to a fully-open position or a position that is more open than it would typically be in at either the FIG. 1 or the FIG. 2 positions. For illustrative purpose, in a disclosed embodiment, the electronic expansion device is fully opened. After a period of time, and as explained above, the refrigerant will now pass from the indoor coil 28 to the outdoor coil 34. This refrigerant migration is due to the fact that the line 26 will be at a much higher pressure than the line 36 after shutdown of the system running in the heating mode of operation.

After a period of time selected sufficient enough for the pressure within the system to equalize and for the refrigerant to move from the indoor heat exchanger 28 to the outdoor heat exchanger 34, the system is again restarted and moved to the FIG. 2 position. The electronic expansion device 30 is also moved to the FIG. 2 position. The system 20 is now in a defrost mode of operation. The abovementioned selected period of time is typically more than thirty (30) seconds and less than three (3) minutes. Rather than having a predetermined period of time for pressure equalization and refrigerant migration at shutdown, while switching between modes of operation, transducers T can be placed in the system locations associated with high and low pressure sides, such as, for instance, on the suction and discharge sides of the compressor 22 (see FIG. 2) to monitor the pressure and ensure equalization.

Figure 4:
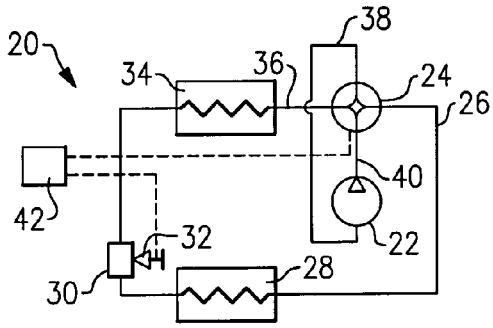
FIG. 4 shows the system shut down and as it would look both before and after the defrost cycle of FIG. 2.

Desirably, when the defrost mode is completed, the system is again stopped, and the electronic expansion device 30 is moved back to the FIG. 4 position. This allows the refrigerant to move back from the outdoor heat exchanger 34 to the indoor heat exchanger 28. The system may then be restarted again in the heating mode without the risk of a flooded start.

Again, operating in the cooling mode merely requires reversing these steps.

Figure 5:
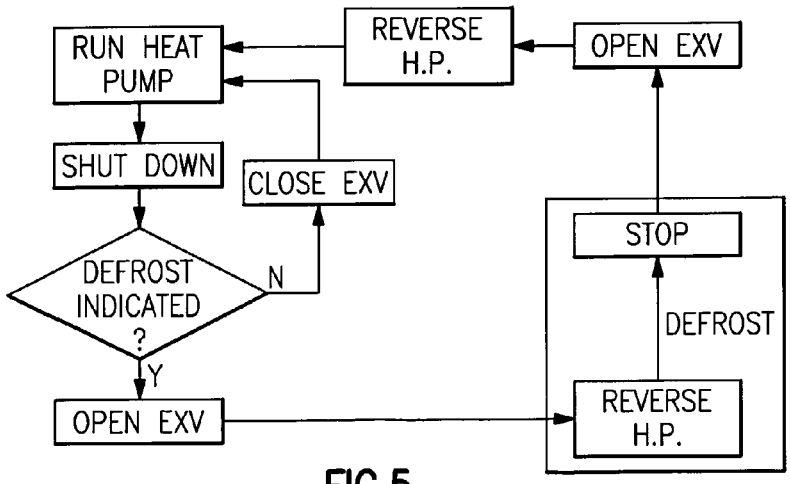
FIG. 5 is a flowchart of the inventive method.

FIG. 5 is a flowchart showing the steps incorporated into this invention.

While preferred embodiments of this invention have been disclosed, a worker of ordinary skill in this art would recognize that certain modifications would come within the scope of this invention. For that reason, the following claims should be studied to determine the true scope and content of this invention.

We claim:

1. A heat pump comprising:

a compressor, a valving system for selectively directing refrigerant from a discharge of said compressor to one of an indoor heat exchanger and an outdoor heat exchanger, and for moving refrigerant from the other of said indoor and outdoor heat exchanger back to a suction of said compressor, said valving system being operable to direct refrigerant from said compressor discharge line to said indoor heat exchanger when in a heating mode, and to direct refrigerant from said compressor discharge to said outdoor heat exchanger when in a cooling mode;

an expansion device intermediate of said indoor and outdoor heat exchangers, said expansion device being an electronic expansion device that can operate in both said cooling mode and said heating mode; and a control for operating said refrigerant system, said control being operable to operate said refrigerant system in one of said heating mode and said cooling mode and determine that a defrost mode is required, said control being operable to stop operation of the heat pump and leave said expansion device in an open position for a period of time such that refrigerant can communicate between said indoor and outdoor heat exchangers, said control then being operable to move said valving system such that refrigerant flows in a manner consistent with the other of said heating mode and said cooling mode for a period of time sufficient to at least partially defrost one of said indoor and outdoor heat exchangers; and said expansion device being moved to a position that is more open than a position for one of said cooling mode and said heating mode when said system is shut down prior to switching into said defrost mode.

2. The refrigerant system as set forth in claim 1, wherein said more open position of said expansion device is a fully open position.

3. The refrigerant system as set forth in claim 1, wherein said expansion device is left in an open position when said defrost mode is terminated.

4. The refrigerant system as set forth in claim 3, wherein said expansion device is moved to a position that is more open than a position for said defrost mode when said system is shut down prior to switching into one of said cooling mode and said heating mode.

5. The refrigerant system as set forth in claim 4, wherein said open position of said expansion device is a fully open position.

6. The refrigerant system as set forth in claim 1, wherein said valving system includes a four-way reversing valve.

7. The refrigerant system as set forth in claim 1, wherein said control determining that said defrost mode is to be terminated, and said control then again shutting down the heat pump, leaving said expansion device in an open position for a period of time, and then moving said valving system back to a position such that the refrigerant flows in an appropriate direction for one of said cooling mode and said heating mode.

8. The refrigerant system of claim 7, wherein said expansion device is moved to a position that is more open than a position for said defrost mode when said system is shut down prior to switching into one of said cooling mode and said heating mode.

9. The refrigerant system as set forth in claim 8, wherein said more open position of said expansion device is a fully open position.

10. The refrigerant system as set forth in claim 7, wherein said period of time is between thirty (30) seconds and three (3) minutes.

11. The refrigerant system as set forth in claim 7, wherein said period of time for leaving open said expansion device prior to said control being operable to move said valving system such that refrigerant flows in a manner consistent with one of said heating mode and said cooling mode, is determined by measuring pressures within the refrigerant system to determine whether a sufficient period of time has elapsed.

12. The refrigerant system as set forth in claim 1, wherein said period of time is between thirty (30) seconds and three (3) minutes.

13. The refrigerant system as set forth in claim 1, wherein said period of time for leaving open said expansion device prior to said control being operable to move said valving system such that refrigerant flows in a manner consistent with the other of said heating mode and said cooling mode is determined by measuring pressures within the refrigerant system to determine whether a sufficient period of time has elapsed.

14. A method of operating a heat pump comprising the steps of:

(1) providing a heat pump including a compressor delivering a compressed refrigerant to a valving system, said valving system delivering said compressed refrigerant to an outdoor heat exchanger when in a cooling mode, and delivering said compressed refrigerant to an indoor heat exchanger when in a heating mode, and providing an expansion device;

(2) operating said heat pump in one of said heating mode and said cooling mode, and monitoring operation of said heat pump to determine when a defrost mode is required;

(3) stopping operation of the heat pump when a defrost mode is required, and opening said expansion device to allow refrigerant to flow between one of said indoor and outdoor heat exchangers to the other;

(4) beginning operation of said defrost mode by operating said heat pump in the other of said heating mode and said cooling mode;

(5) stopping operation of said defrost mode, and beginning operation in said one of said heating and cooling modes; and (6) moving said expansion device to a position that is more open than a position for one of said cooling mode and said heating mode.

15. The method as set forth in claim 14, wherein said expansion device is also opened intermediate after stopping the defrost cycle and before beginning operation in one of said cooling mode and said heating mode.

16. The method as set forth in claim 14, wherein said expansion device is moved to a fully open position when said defrost mode is terminated.

17. The method as set forth in claim 14, wherein said valving system is a four-way reversing valve.

18. The method as set forth in claim 14, wherein said expansion device is moved to a fully opened position in step (3).

19. The method as set forth in claim 14, wherein a period of time for step (3) is determined by measuring pressures within the refrigerant system to determine whether a sufficient period of time has elapsed.

20. The method as set forth in claim 14, wherein a period of time for step (3) is between thirty (30) seconds and three (3) minutes.

* * * * *